US009069328B2

(12) United States Patent
Ishikawa et al.

(10) Patent No.: US 9,069,328 B2
(45) Date of Patent: Jun. 30, 2015

(54) CARTRIDGE

(71) Applicant: Brother Kogyo Kabushiki Kaisha, Nagoya-shi, Aichi-ken (JP)

(72) Inventors: Satoru Ishikawa, Kitanagoya (JP); Keita Shimizu, Tsushima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/334,160

(22) Filed: Jul. 17, 2014

(65) Prior Publication Data

US 2015/0023688 A1 Jan. 22, 2015

(30) Foreign Application Priority Data

Jul. 19, 2013 (JP) ..... 2013-150923

(51) Int. Cl.
*G03G 21/16* (2006.01)
*G03G 21/18* (2006.01)

(52) U.S. Cl.
CPC ..... *G03G 21/1661* (2013.01); *G03G 21/1814* (2013.01)

(58) Field of Classification Search
CPC ..... G03G 21/1803; G03G 21/1814; G03G 2221/183
See application file for complete search history.

(56) References Cited

U.S. PATENT DOCUMENTS

| | | | | |
|---|---|---|---|---|
| 6,041,203 | A | 3/2000 | Suzuki et al. | |
| 6,330,410 | B1 | 12/2001 | Okabe et al. | |
| 7,826,768 | B2 * | 11/2010 | Ishikawa | 399/114 |
| 8,600,267 | B2 * | 12/2013 | Sato | 399/254 |
| 2007/0048008 | A1 | 3/2007 | Kamimura | |

FOREIGN PATENT DOCUMENTS

| | | | |
|---|---|---|---|
| JP | 2001-075457 | A | 3/2001 |
| JP | 2007-057646 | A | 3/2007 |
| JP | 2009-251201 | A | 10/2009 |

* cited by examiner

*Primary Examiner* — Gregory H Curran
(74) *Attorney, Agent, or Firm* — Banner & Witcoff, Ltd.

(57) ABSTRACT

A cartridge may include a conveyor roller extending along a rotational axis and a bearing member for rotatably supporting the conveyor roller. The conveyor roller may include a larger-diameter portion for conveying a sheet, and a smaller-diameter portion. The bearing member may rotatably support the smaller-diameter portion of the conveyor roller, and engage the housing. In one or more arrangements, the entire smaller-diameter portion of the conveyor roller may be located at a more outward position, relative to a midpoint of the larger-diameter portion, than a portion of the bearing member supporting the smaller-diameter portion of the conveyor roller.

20 Claims, 10 Drawing Sheets

CARTRIDGE

CROSS-REFERENCE TO RELATED APPLICATION

This application claims priority from Japanese Patent Application No. 2013-150923, filed on Jul. 19, 2013, which is incorporated herein by reference in its entirety.

TECHNICAL FIELD

Aspects disclosed herein relate to a photosensitive body cartridge detachably attachable to an apparatus body of an electrophotographic image forming apparatus.

BACKGROUND

Image forming apparatuses equipped with a photosensitive body cartridge that is detachable from an apparatus body of the image forming apparatus exist. The photosensitive body cartridge is capable of accommodating a developing cartridge storing toner therein. The photosensitive body cartridge is configured to be attached to and detached from the apparatus body while accommodating the developing cartridge therein.

During an image forming operation, a sheet is generally conveyed toward a photosensitive body. Therefore, a pair of registration rollers is disposed in the apparatus body. In the image forming apparatus, in order to keep the pair of registration rollers out of the way of the attaching/detaching operation of the photosensitive body cartridge with respect to the apparatus body, one of the pair of registration rollers is disposed on the photosensitive body cartridge and the other of the pair of registration rollers is disposed on the apparatus body.

Bearing members for supporting the one of the pair of registration rollers rotatably are attached on the photosensitive body cartridge of the image forming apparatus. The one of the pair of registration rollers is rotatably supported by the bearing members.

Upon the attachment of the photosensitive body cartridge to the apparatus body, the one of the pair of registration rollers comes into contact with the other of the pair of registration rollers. As both registration rollers rotate under this condition, a sheet is conveyed toward the photosensitive body.

In the above-described photosensitive body cartridge, an outside diameter of the one of the pair of registration rollers is narrowed partially at each end portion thereof, and the bearing members support the narrowed portions of the one of the pair of registration rollers, respectively.

SUMMARY

In some examples, to achieve a stable sheet conveyance, the one of the pair of registration rollers may need to be brought into pressure contact with the other of the pair of registration rollers using a constant force. By doing so, however, the force may be exerted on the narrowed portions of the one of the pair of registration rollers supported by the bearing members, thereby causing deformation in the one registration roller. Such deformation may cause an unstable sheet conveyance.

Accordingly, for example, at least some embodiments of the disclosure provide for a photosensitive body cartridge that may achieve a stable sheet conveyance.

According to aspects described herein, a photosensitive body cartridge may comprise a photosensitive body, a housing, a sheet conveyor roller, and a bearing member. The photosensitive body may be configured to rotate on a first rotational axis. The housing may support the photosensitive body rotatably. The sheet conveyor roller may extend along a second rotational axis that extends along the first rotational axis. The sheet conveyor roller may comprise a larger-diameter portion for conveying a sheet, and a smaller-diameter portion having a smaller diameter than the larger-diameter portion. The bearing member may be configured to support the sheet conveyor roller rotatably. The bearing member may comprise a support portion configured to support the smaller-diameter portion of the sheet conveyor roller rotatably, and an engagement portion configured to engage with the housing. An entire portion of the smaller-diameter portion may be located at a more outward position than the engagement portion in a direction coinciding with the second rotational axis.

Accordingly, aspects of the disclosure may provide the photosensitive body cartridge that may achieve a stable sheet conveyance.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

1. Overview of Photosensitive Body Cartridge

Figure 1:
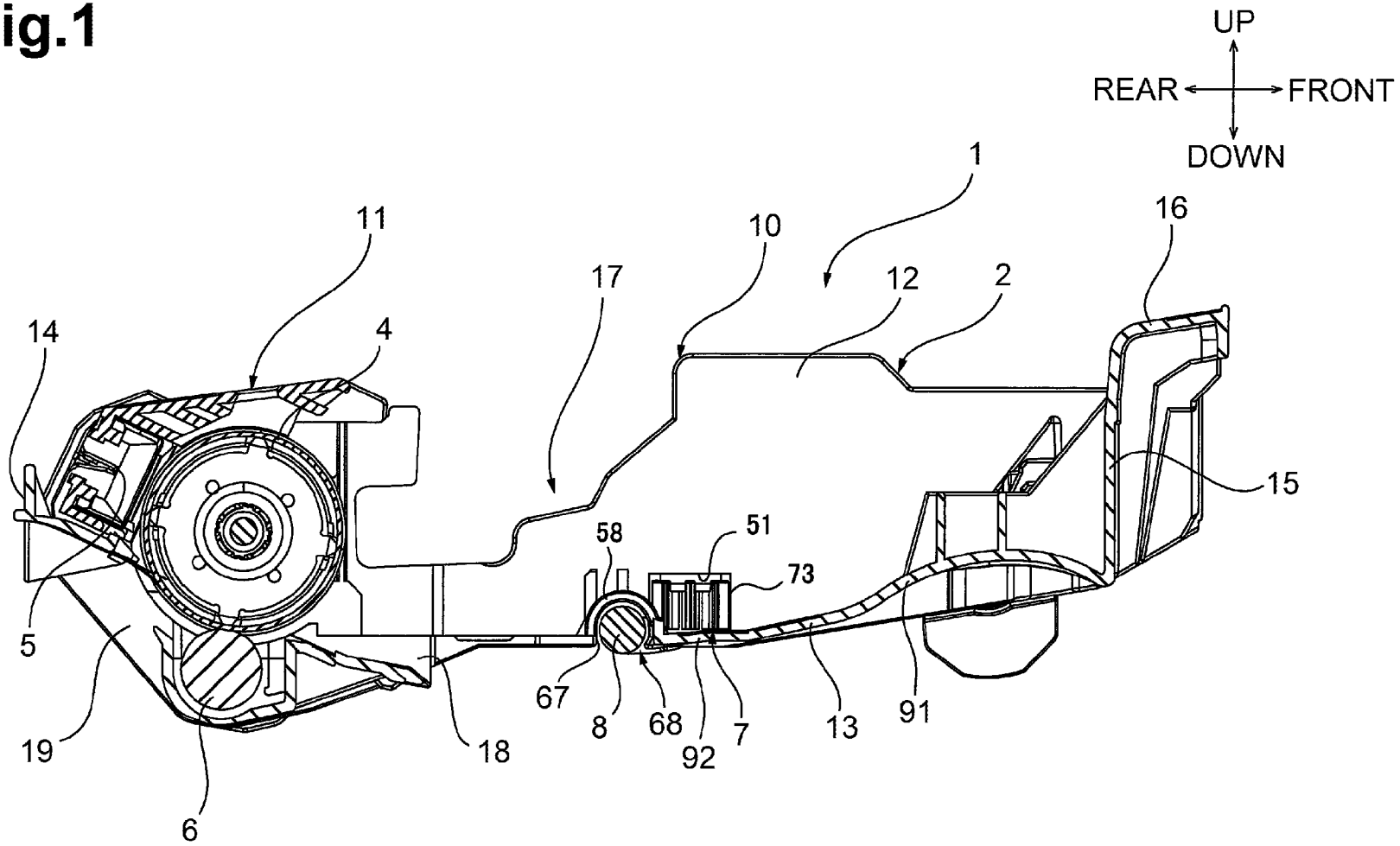
FIG. 1 is a central cross sectional view depicting a photosensitive body cartridge in an illustrative embodiment according to one or more aspects of the disclosure.
Figure 2:
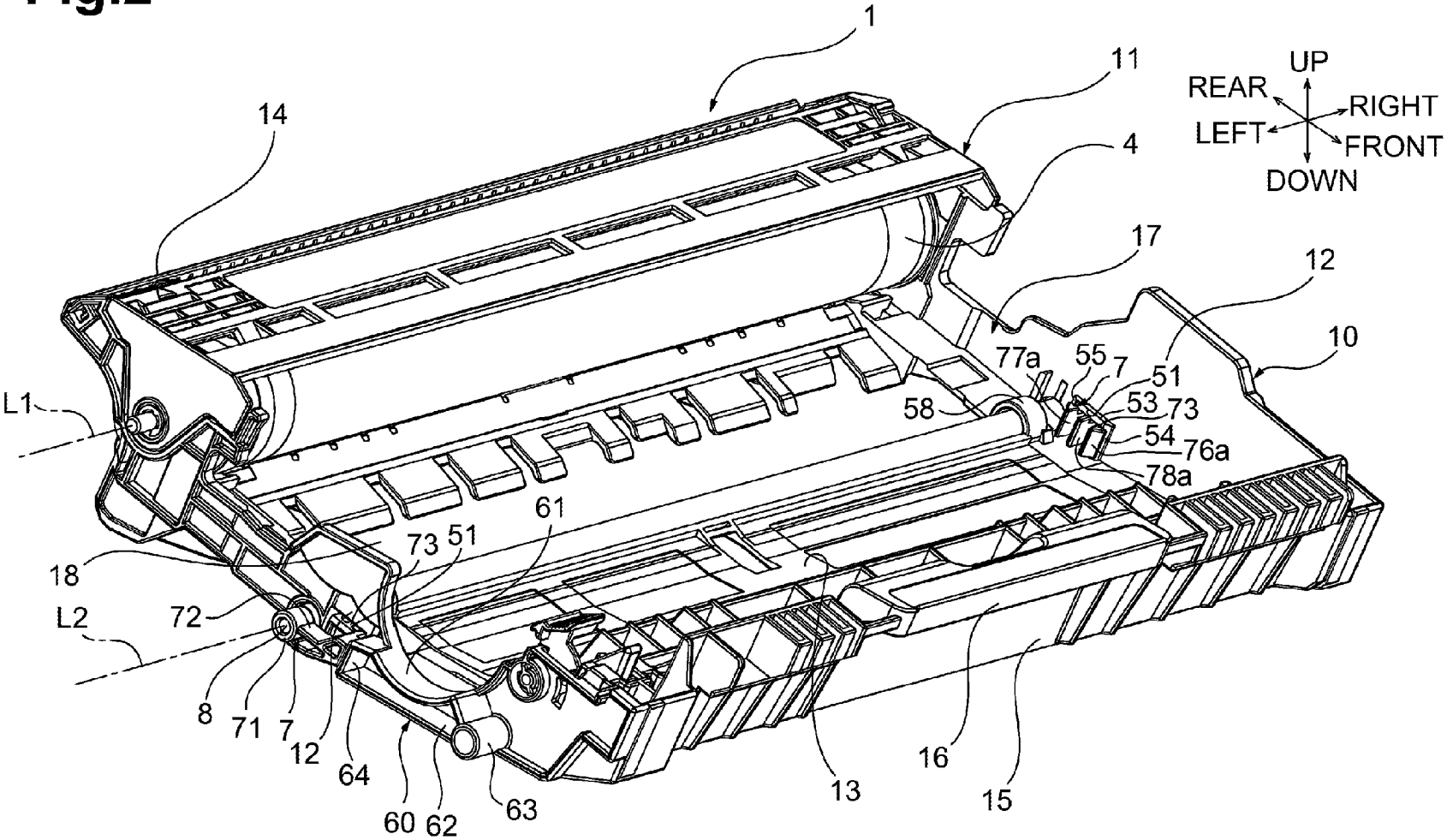
FIG. 2 is an upper left front perspective view depicting the photosensitive body cartridge of FIG. 1 in the illustrative embodiment according to one or more aspects of the disclosure.
Figure 5:
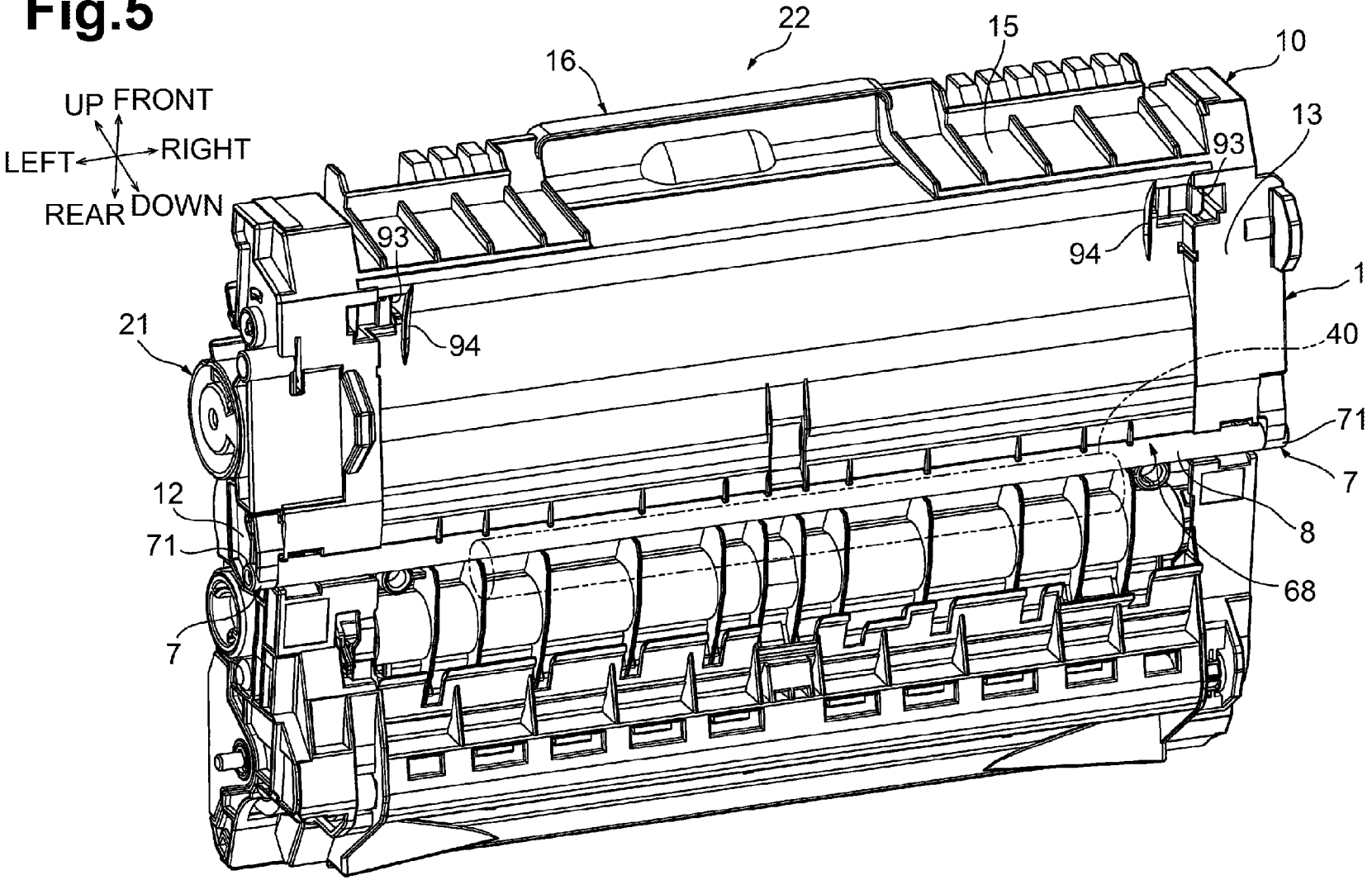
FIG. 5 is a lower left front perspective view depicting the process cartridge of FIG. 3 in the illustrative embodiment according to one or more aspects of the disclosure.

As depicted in FIGS. 1, 2, and 5, a photosensitive body cartridge 1 may comprise a drum frame 2 as an example of a housing, a photosensitive drum 4, a scorotron charger 5, a transfer roller 6, a pair of bearing members 7, and a cartridge-side registration roller 8 as an example of a sheet conveyor roller.

In the description below, an up-down direction may be defined with reference to an orientation of the photosensitive body cartridge 1 as depicted in FIG. 1. A side of the photosensitive body cartridge 1, in which the scorotron charger 5 may be disposed with reference to the photosensitive drum 4, may be defined as the rear of the photosensitive body cartridge 1. A side of the photosensitive body cartridge 1, in which the cartridge-side registration roller 8 may be disposed with reference to the photosensitive drum 4, may be defined as the front of the photosensitive body cartridge 1. The right and left of the photosensitive body cartridge 1 may be defined with respect to the photosensitive body cartridge 1 as viewed from its front. A right-left direction may be an example of a direction along a first rotational axis and an example of a direction along a second rotational axis. A front-rear direction may be an example of a third direction.

The drum frame 2 may comprise a base frame 10 and a cover frame 11.

The base frame 10 may have a substantially rectangular shape with a bottom surface in plan view. The base frame 10 may comprise a pair of side walls 12, a lower wall 13, a rear wall 14, and a front wall 15 that may be integral with each other.

The side walls 12 may extend in the front-rear direction while being spaced apart from each other at a predetermined interval in the right-left direction. Each of the pair of side walls 12 may have a substantially rectangular flat plate shape in side view.

The lower wall 13 may be disposed between lower end portions of the side walls 12 and extend in the front-rear direction. The lower wall 13 may have a substantially rectangular flat plate shape in plan view. The lower wall 13 may have a first opening 18 and a pair of fifth openings 93, and comprise a first curved portion 91, a second curved portion 92, and a pair of ribs 94.

The first opening 18 may be defined in a middle portion of the lower wall 13 and have a substantially rectangular shape in plan view. A dimension of the first opening 18 in the right-left direction may be greater than a dimension of a sheet P in a width direction.

The first curved portion 91 may be curved upward at a forward portion of the lower wall 13.

The second curved portion 92 may be curved upward at a middle portion of the lower wall 13. The second curved portion 92 may be located more rearward than the first curved portion 91 and the cartridge-side registration roller 8 while being spaced apart from the first curved portion 91 in the front-rear direction.

A curvature of the first curved portion 91 may be greater than a curvature of the second curved portion 92. The first curved portion 91 and the second curved portion 92 may define a portion of a sheet conveyance path in a state where the photosensitive body cartridge 1 is attached on an apparatus body 31 of an image forming apparatus 30.

The fifth openings 93 may be defined in respective end portions of the forward portion of the lower wall 13 in the right-left direction and may have a substantially rectangular shape in plan view. The fifth openings 93 may expose therefrom pressure members (not depicted) for pressing the developing cartridge 21 toward the photosensitive drum 4.

The ribs 94 may protrude downward from the respective end portions of the forward portion of the lower wall 13 in the right-left direction. A length of each rib 94 in the front-rear direction may be longer than a length of each fifth opening 93 in the front-rear direction. The ribs 94 may be adjacent to the fifth openings 93, respectively, in the right-left direction and may be disposed at respective positions that are more inward than the positions of the respective fifth openings 93 in the right-left direction.

The rear wall 14 may be disposed above a rear end portion of the lower wall 13 and extend in the right-left direction. The rear wall 14 may have a substantially rectangular flat plate shape in front view. Both right and left ends of the rear wall 14 may be contiguous to rear ends, respectively, of the side walls 12.

A lower end of the rear wall 14 and a rear end of the lower wall 13 may be spaced apart from each other in the up-down direction to define a second opening 19 therebetween. The second opening 19 may have a rectangular shape in which a dimension of the second opening 19 in the right-left direction may be greater than the width of the sheet P.

The front wall 15 may extend upwardly and contiguously from a front end of the lower wall 13. The front wall 15 may have a substantially rectangular flat plate shape in front view. Both right and left ends of the front wall 15 may be contiguous to front ends, respectively, of the side walls 12. The front wall 15 may comprise a handle 16.

The handle 16 may be disposed at a substantially middle portion of the front wall 15 in the right-left direction. The handle 16 may have a substantially rectangular flat plate in plan view. The handle 16 may extend forward from an upper end portion of the front wall 15.

The cover frame 11 may be disposed above the rear end portion of the base frame 10 to cover the photosensitive drum 4. The cover frame 11 may hold the scorotron charger 5.

A portion that may be defined by the front wall 15, the lower wall 13, and portions of the side walls 12, which may be located forward than the cover frame 11, may serve as a developing cartridge mount portion 17.

The photosensitive drum 4 may have a substantially cylindrical shape extending in the right-left direction, and may be rotatably supported at the rear end portions of the pair of side walls 12. With this configuration, the photosensitive drum 4 may be rotatable on a first rotational axis L1 extending in the right-left direction.

The scorotron charger 5 may be spaced apart from the photosensitive drum 4 and disposed behind the photosensitive drum 4.

The transfer roller 6 may have a substantially cylindrical shape extending in the right-left direction, and may be rotatably supported at the rear end portions of the pair of side walls 12. The transfer roller 6 may be disposed below the photosensitive drum 4 and its upper end portion may be in contact with a lower end portion of the photosensitive drum 4.

In the developing cartridge mount portion 17, the bearing members 7 may be attached on the side walls 12, respectively, at positions more forward than the first opening 18.

The cartridge-side registration roller 8 may have a substantially cylindrical shape extending in the right-left direction. Both end portions of the cartridge-side registration roller 8 may be rotatably supported by the respective bearing members 7. With this configuration, the cartridge-side registration roller 8 may be rotatable on a second rotational axis L2 extending in the right-left direction. The cartridge-side registration roller 8 may be made of metal.

2. Overview of Process Cartridge

Figure 3:
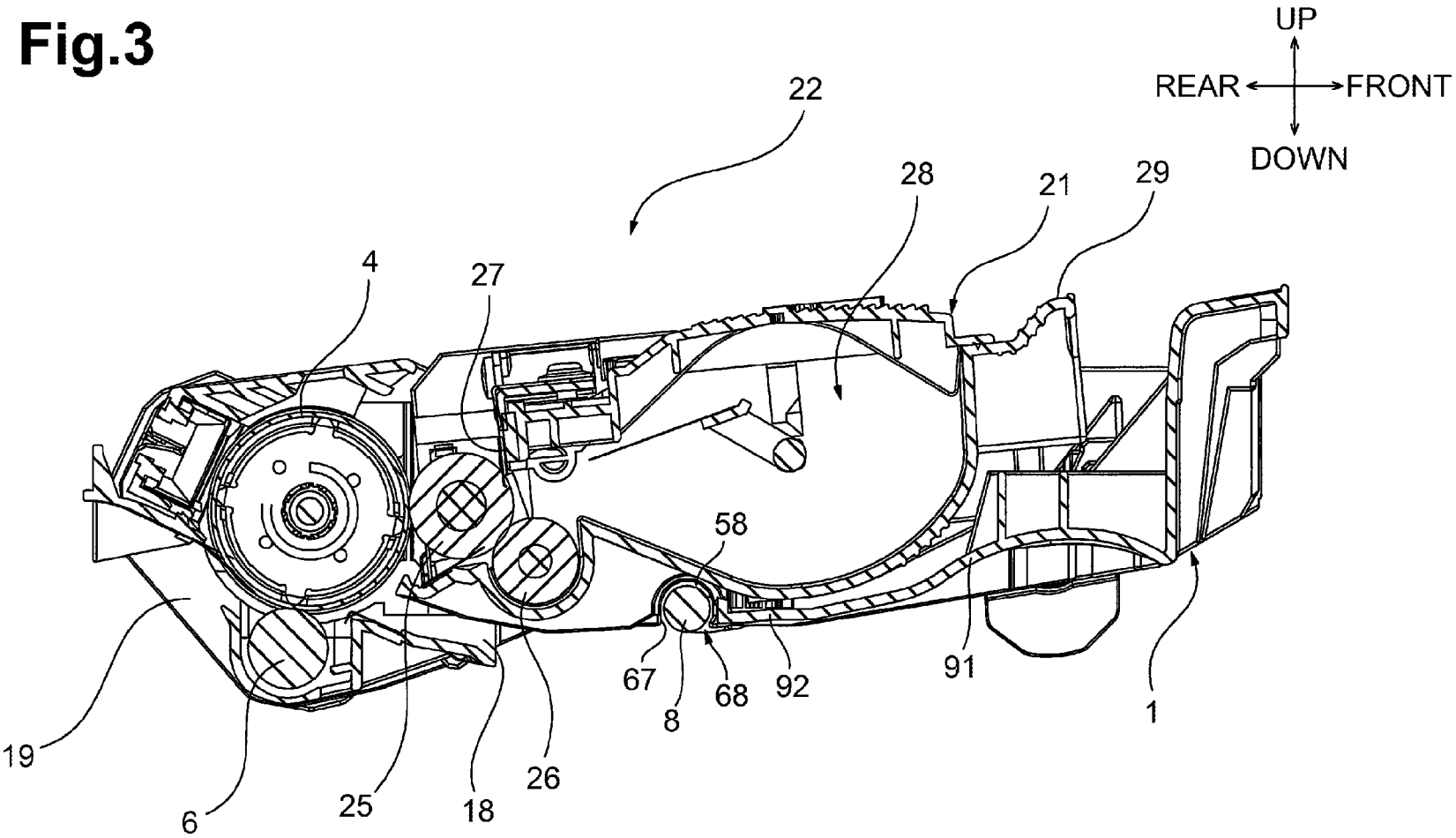
FIG. 3 is a central cross sectional view depicting a process cartridge in which a developing cartridge is attached on the photosensitive body cartridge of FIG. 1 in the illustrative embodiment according to one or more aspects of the disclosure.
Figure 4:
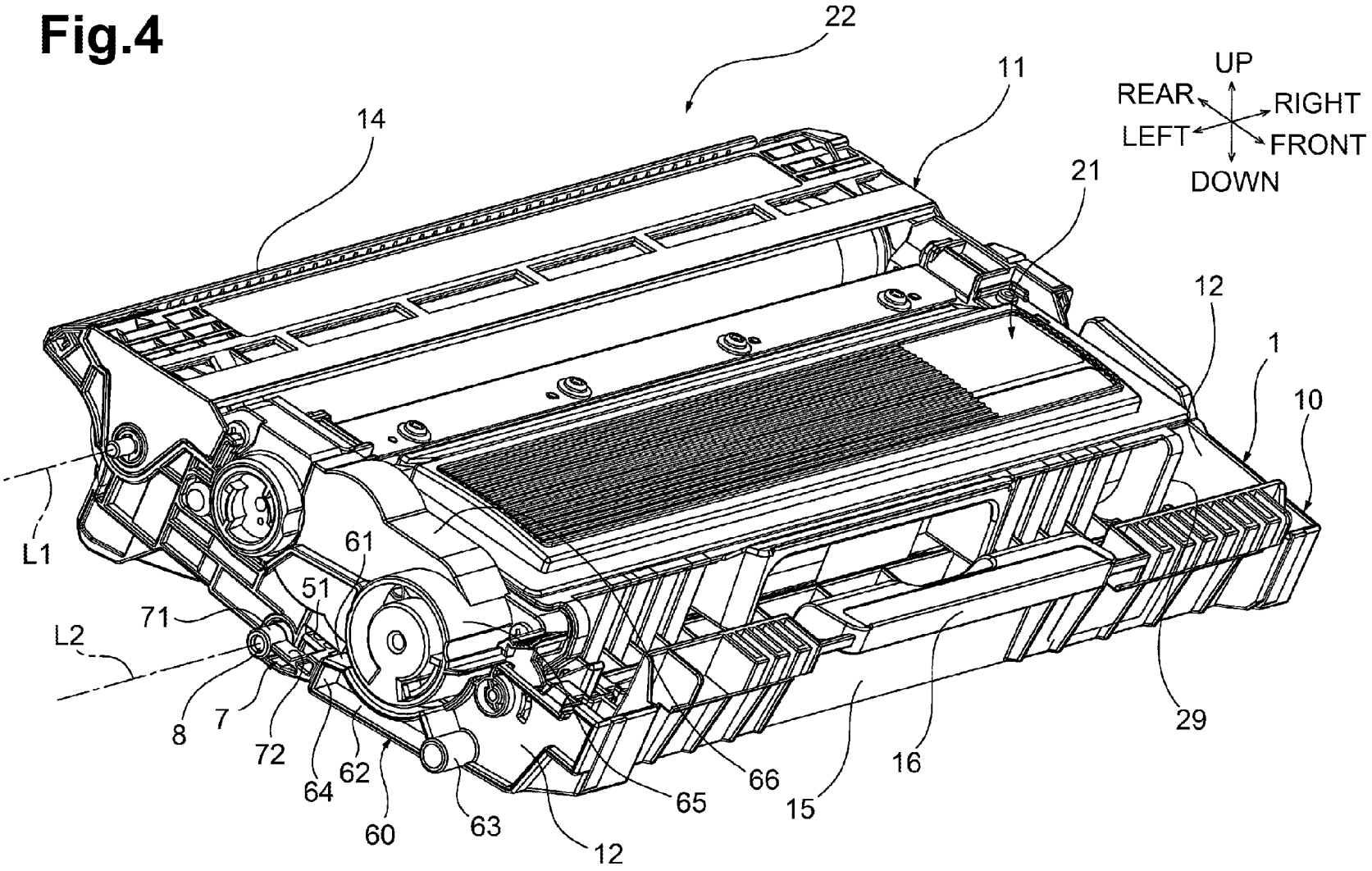
FIG. 4 is an upper left front perspective view depicting the process cartridge of FIG. 3 in the illustrative embodiment according to one or more aspects of the disclosure.

As depicted in FIGS. 3, 4, and 5, the developing cartridge 21 may be detachably attached to the developing cartridge mount portion 17 of the photosensitive body cartridge 1. The process cartridge 22 may include the photosensitive body cartridge 1 and the developing cartridge 21.

The developing cartridge 21 may comprise a developing frame 29, a developing roller 25, a supply roller 26, a layer thickness regulating blade 27, and a toner storage portion 28.

The developing frame 29 may have a substantially box shape with an open back.

The developing roller 25 may have a substantially cylindrical shape extending in the right-left direction. The developing roller 25 may be rotatably supported at a rearward portion of the developing frame 29. A rear end portion of the developing roller 25 may be exposed from the developing frame 29 while being in contact with a front end portion of the photosensitive drum 4.

The supply roller 26 may have a substantially cylindrical shape extending in the right-left direction. The supply roller 26 may be rotatably supported at the rearward portion of the developing frame 29. The supply roller 26 may be disposed below and forward of the developing roller 25, and an upper rear end portion of the supply roller 26 may be in contact with a lower front end portion of the developing roller 25.

The layer thickness regulating blade 27 may be disposed above and forward of the developing roller 25. An upper end portion of the layer thickness regulating blade 27 may be supported by the developing frame 29, and a lower end portion of the layer thickness regulating blade 27 may be in contact with a front end portion of the developing roller 25.

The toner storage portion 28 may be an internal space defined in the developing frame 29 and located forward than the supply roller 26 and the layer thickness regulating blade 27. The toner storage portion 28 may be configured to store therein toner, as an example of developer agent.

A gear cover 66 comprising a cylinder portion 65 for covering a detection unit may be attached on a left side wall of the developing frame 29.

3. Usage of Photosensitive Body Cartridge

Figure 6:
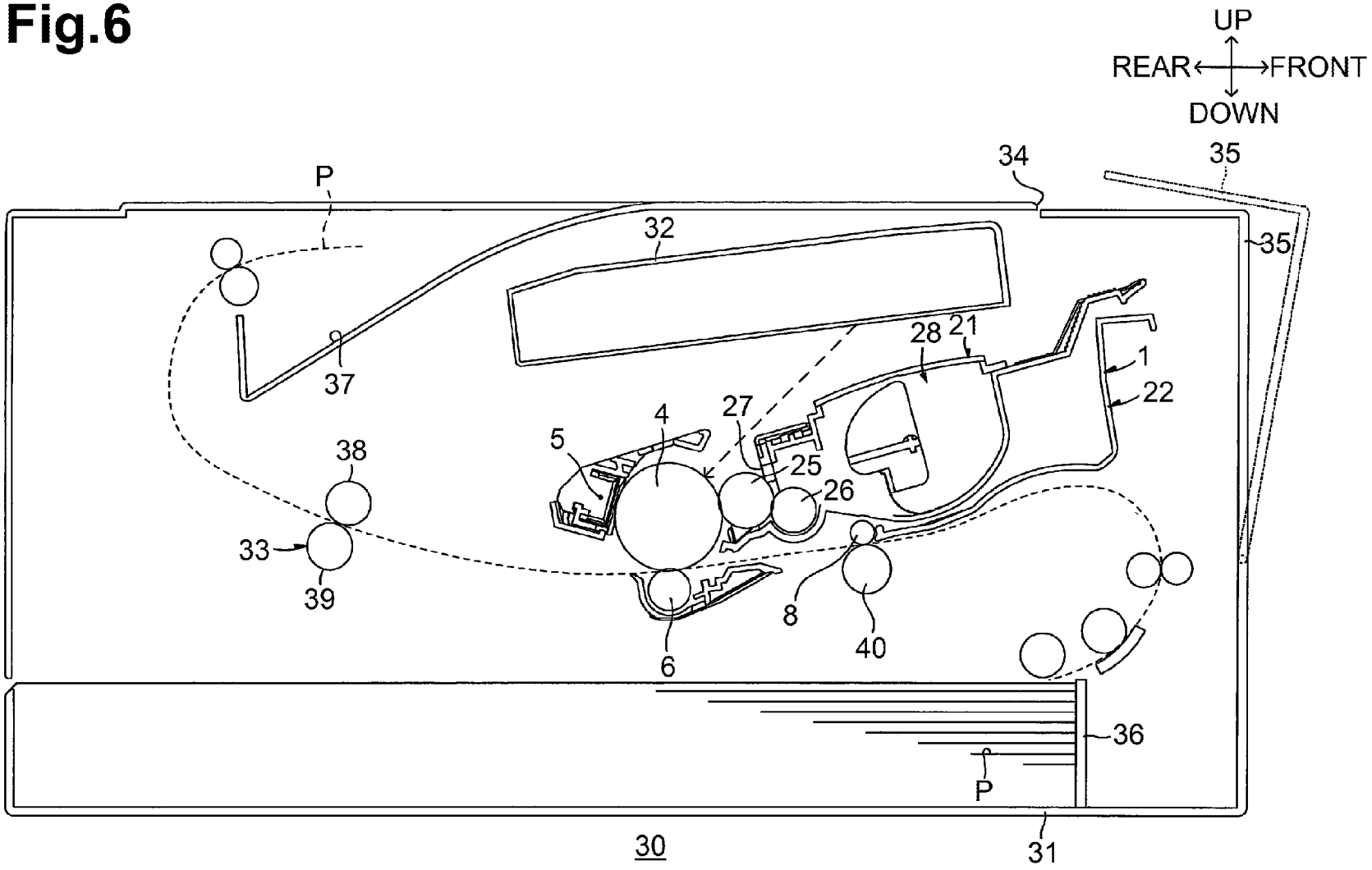
FIG. 6 is a central cross sectional view depicting an image forming apparatus in which the process cartridge of FIG. 3 is attached in the illustrative embodiment according to one or more aspects of the disclosure.

As depicted in FIG. 6, the photosensitive body cartridge 1 on which the developing cartridge 21 may be attached, that is, the process cartridge 22, may be used while being attached in the image forming apparatus 30.

The image forming apparatus 30 may be an electrophotographic monochrome printer. The image forming apparatus 30 may comprise the apparatus body 31, the process cartridge 22, a scanner unit 32, a fixing unit 33, and an apparatus-side registration roller 40.

The apparatus body 31 may have a substantially box shape. The apparatus body 31 may have an opening 34 and comprise a front cover 35, a sheet feed tray 36, and a sheet discharge tray 37.

The opening 34 may be defined in a front end of the apparatus body 31. The opening 34 may allow the inside and outside of the apparatus body 31 to communicate with each other in the front-rear direction to allow the process cartridge 22 to pass therethrough.

The front cover 35 may be disposed at a front end of the apparatus body 31. The front cover 35 may have a substantially L-shape in side view. The front cover 35 may be supported by a front wall of the apparatus body 31 so as to be pivotable on a lower end of the front cover 35. The front cover 35 may be configured to close and expose the opening 34.

The sheet feed tray 36 may be disposed in a lower portion of the apparatus body 31. The sheet feed tray 36 may be configured to accommodate one or more sheets P therein.

The sheet discharge tray 37 may be disposed at a rear half of an upper wall of the apparatus body 31. The sheet discharge tray 37 may be lowered toward the rear at an upper surface of the upper wall of the apparatus body 31 to support one or more sheets P thereon.

The process cartridge 22 may be accommodated in a substantially middle portion of the apparatus body 31 in the up-down direction. The process cartridge 22 may be configured to be attached to and detached from the apparatus body 31.

The scanner unit 32 may be disposed above the process cartridge 22. The scanner unit 32 may be configured to irradiate the photosensitive drum 4 with a laser beam based on image data.

The fixing unit 33 may be disposed behind the process cartridge 22. The fixing unit 33 may comprise a heat roller 38 and a pressure roller 39. The pressure roller 39 may be in pressure contact with a lower rear end portion of the heat roller 38.

The apparatus-side registration roller 40 may have a substantially cylindrical shape extending in the right-left direction. The apparatus-side registration roller 40 may be rotatably supported below the process cartridge 22. An upper end portion of the apparatus-side registration roller 40 may be in contact with a lower end portion of the cartridge-side registration roller 8.

As the image forming apparatus 30 starts an image forming operation, the scorotron charger 5 may uniformly charge a surface of the photosensitive drum 4. The scanner unit 32 may then expose the surface of the photosensitive drum 4. Thus, an electrostatic latent image based on image data may be formed on the surface of the photosensitive drum 4.

The supply roller 26 may supply toner stored in the toner storage portion 28 to the developing roller 25. At that time, toner may be frictionally charged to have a positive charge between the developing roller 25 and the supply roller 26, and then may be carried by the developing roller 25. The layer thickness regulating blade 27 may regulate a thickness of a toner layer carried by the developing roller 25 to a constant thickness.

Thereafter, toner carried by the developing roller 25 may be supplied to the electrostatic latent image held on the surface of the photosensitive drum 4. Thus, a toner image may be held on the surface of the photosensitive drum 4.

One or more sheets P may be conveyed, one by one, to between the cartridge-side registration roller 8 and the apparatus-side registration roller 40 at a predetermined timing from the sheet feed tray 36 by rotation of various rollers. Then, by rotation of the cartridge-side registration roller 8 and the apparatus-side registration roller 40, as depicted in FIGS. 1 and 6, the sheet P may be further conveyed to between the photosensitive drum 4 and the transfer roller 6 via the first opening 18. The toner image held on the surface of the photosensitive drum 4 may be then transferred onto the sheet P while the sheet P passes between the photosensitive drum 4 and the transfer roller 6.

Thereafter, the sheet P may pass through the second opening 19. As the sheet P passes between the heat roller 38 and the pressure roller 39, heat and pressure may be applied on the sheet P. Thus, the toner image held on the sheet P may be thermally fixed on the sheet P. Then, the sheet P may be discharged onto the sheet discharge tray 37.

4. Configuration of Cartridge-Side Registration Roller (4-1) Drum Frame

Figure 7:
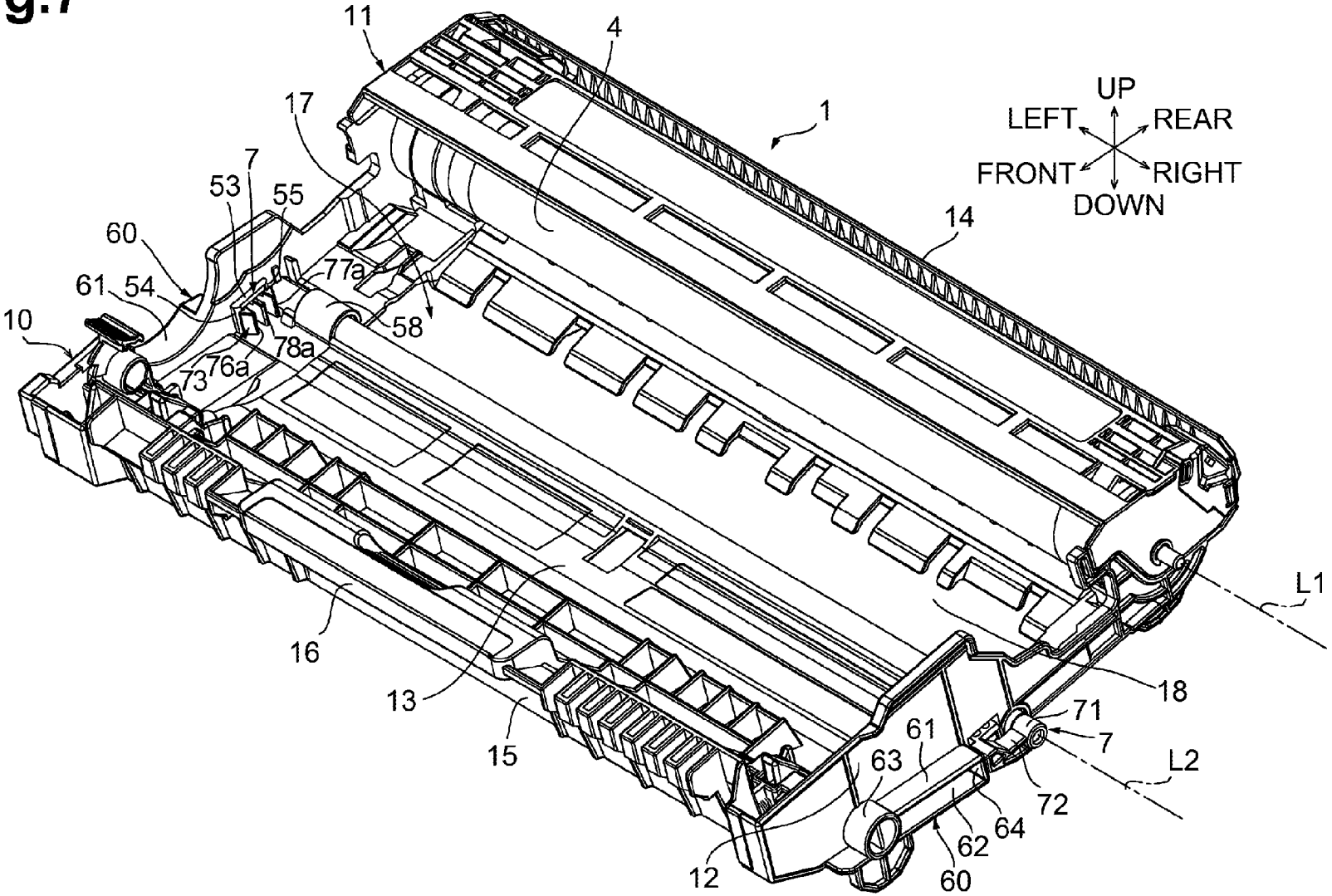
FIG. 7 is an upper right front perspective view depicting the photosensitive body cartridge of FIG. 1 in the illustrative embodiment according to one or more aspects of the disclosure.
Figure 9A:
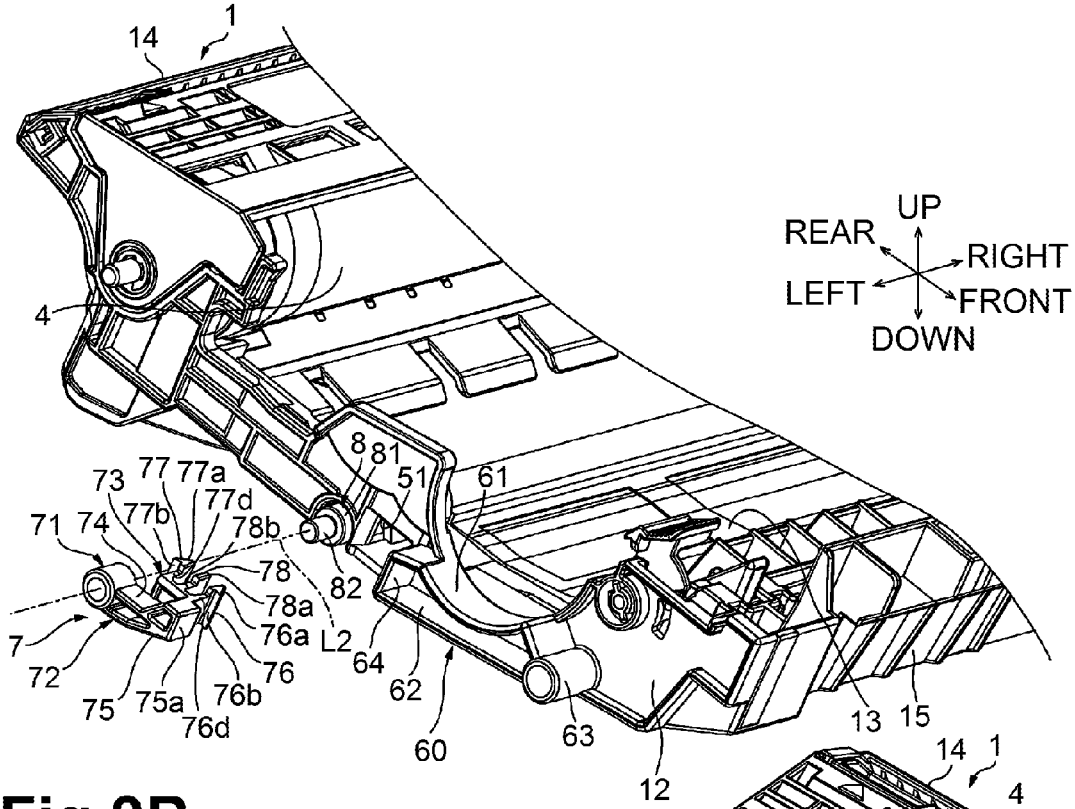
FIG. 9A is an upper left front perspective view depicting the cartridge-side registration roller and the bearing member before the bearing member is assembled to the cartridge-side registration roller in the illustrative embodiment according to one or more aspects of the disclosure.
Figure 9B:
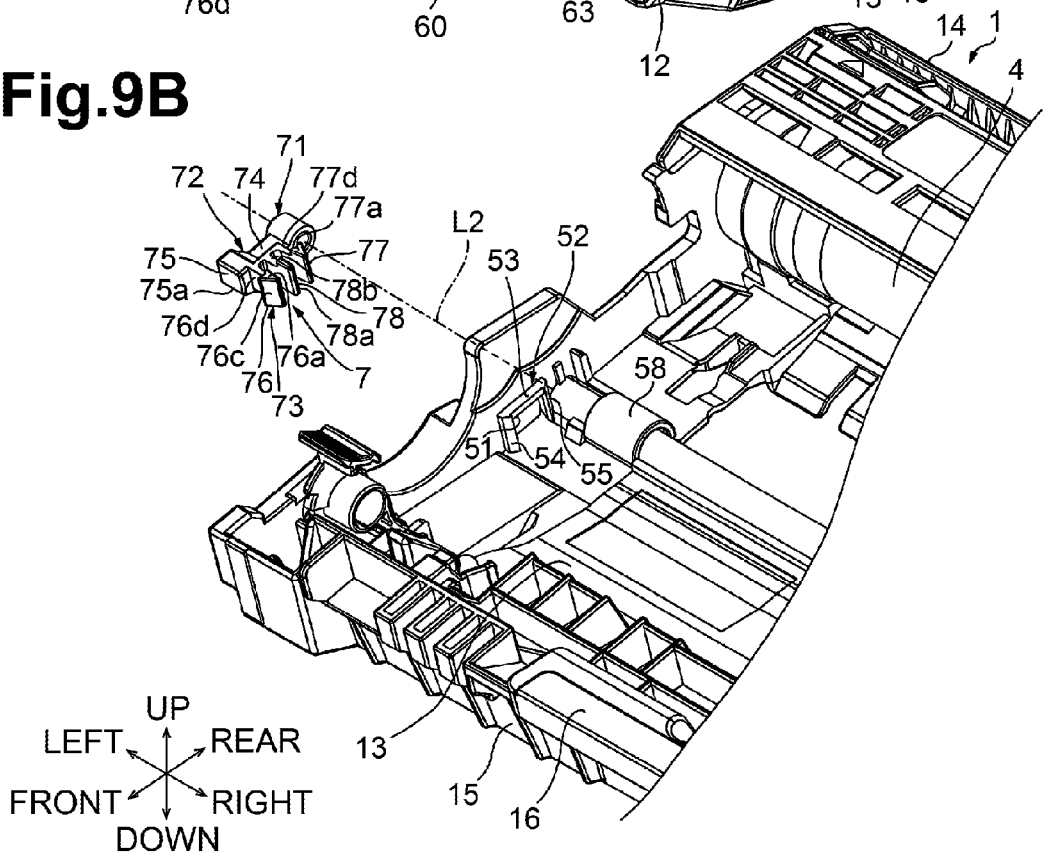
FIG. 9B is an upper right front perspective view depicting the cartridge-side registration roller and the bearing member before the bearing member is assembled to the cartridge-side registration roller in the illustrative embodiment according to one or more aspects of the disclosure.

As depicted in FIGS. 1, 7, and 9B, each of the pair of side walls 12 of the base frame 10 of the photosensitive body cartridge 1 may have a third opening 51 and comprise a frame protrusion 52 as an example of a first protrusion, and a projecting portion 60. The pair of side walls 12 may be a symmetrical structure, and therefore, only one of the pair of side walls 12 is described in detail below. The lower wall 13 may comprise a roller accommodation portion 68.

(4-1-1) Third Opening

The third opening 51 may be defined in a substantially middle portion of the side wall 12 and may pass through the side wall 12 in the right-left direction. The third opening 51 may have a substantially rectangular shape in side view. The third opening 51 may allow an engagement portion 73 to pass therethough. A lower edge of the third opening 51 may be defined by an edge of the lower wall 13 in the right-left direction. The third opening 51 may be disposed more forward than the first opening 18 in the front-rear direction.

(4-1-2) Frame Protrusion

Figure 8:
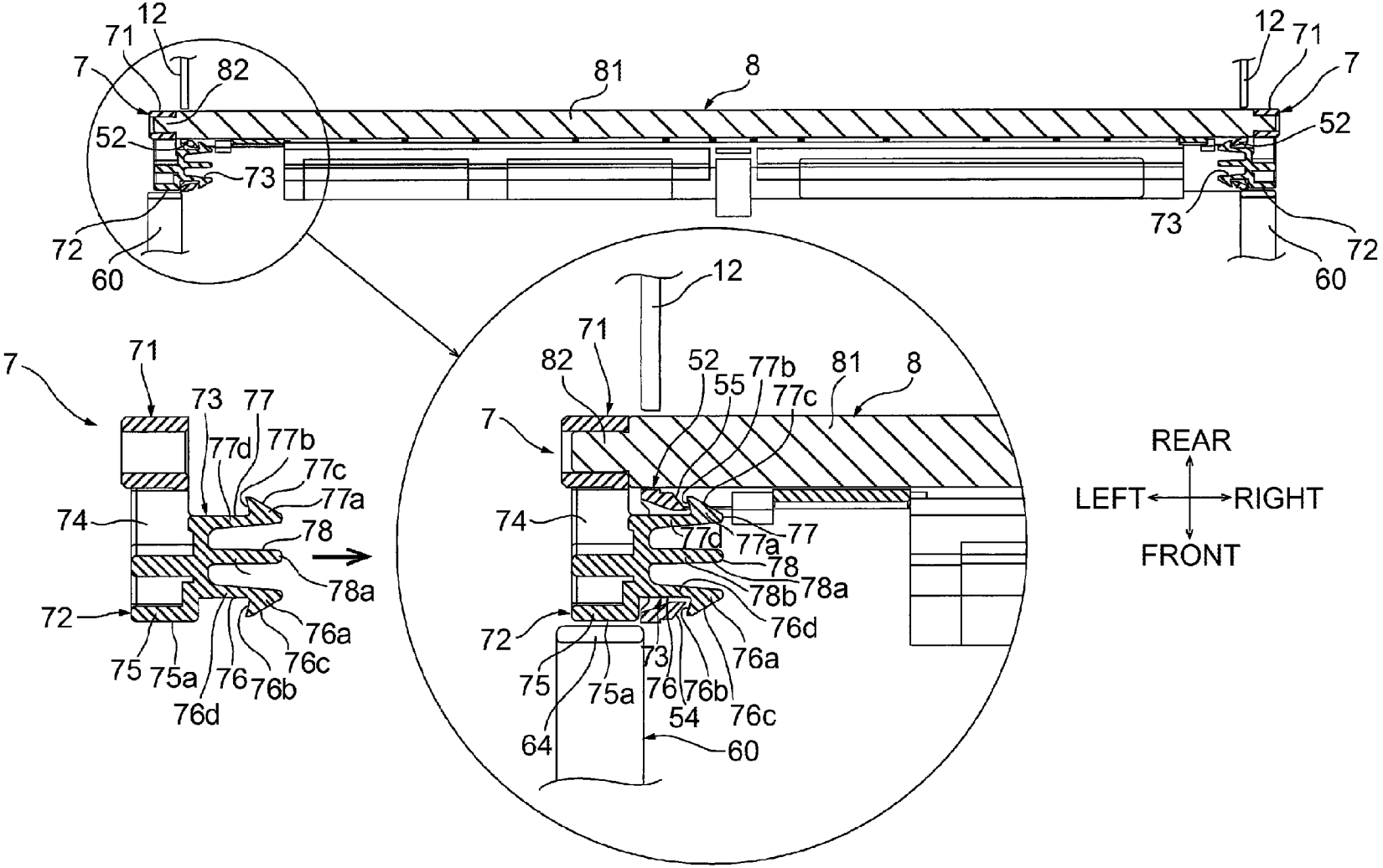
FIG. 8 is a sectional view depicting a bearing member and a cartridge-side registration roller in the illustrative embodiment according to one or more aspects of the disclosure.

As depicted in FIGS. 8 and 9B, the frame protrusion 52 may be disposed on an inner surface of the side wall 12 in the right-left direction and around a periphery of the third opening 51.

The frame protrusion 52 may comprise an upper projecting portion 53, a front projecting portion 54, and a rear projecting portion 55.

The upper projecting portion 53 may protrude inward from the inner surface of the side wall 12 in the right-left direction and extend along an upper edge of the third opening 51 in the front-rear direction.

The front projecting portion 54 may protrude inward from the inner surface of the side wall 12 in the right-left direction and extend along a front edge of the third opening 51 in the up-down direction. An upper end portion of the front projecting portion 54 may be contiguous to a front end portion of the upper projecting portion 53. A protruding end portion of the front projecting portion 54 may be inclined rearward, i.e., inward of the third opening 51, toward its extremity.

The rear projecting portion 55 may protrude inward from the inner surface of the side wall 12 in the right-left direction and extend along a rear edge of the third opening 51 in the up-down direction. An upper end portion of the rear projecting portion 55 may be contiguous to a rear end portion of the upper projecting portion 53. A protruding end portion of the rear projecting portion 55 may be inclined forward, i.e., inward of the third opening 51, toward its extremity.

(4-1-3) Projecting Portion

As depicted in FIGS. 4 and 9A, the projecting portion 60 may serve as an outer end surface of the side wall 12 in the right-left direction. The projecting portion 60 may be disposed in front of the frame protrusion 52 in the front-rear direction. The projecting portion 60 may have a trapezoidal frame shape in side view and protrude outward from the side wall 12 in the right-left direction. The projecting portion 60 may comprise an upper beam 61, a lower beam 62, a front boss 63, and a rear beam 64.

The upper beam 61 may have a plate-like shape. The upper beam 61 may protrude outward from the side wall 12 in the right-left direction and extend in the front-rear direction. The upper beam 61 of the projecting portion 60 disposed on the left side wall 12 may be curved downward at a middle portion. With this configuration, the cylinder portion 65 of the gear cover 66 may be placed on an upper surface of the upper beam 61 of the left projecting portion 60 in a state where the developing cartridge 21 is attached on the photosensitive body cartridge 1.

The lower beam 62 may have a plate-like shape. The lower beam 62 may protrude outward from the side wall 12 in the right-left direction and extend in the front-rear direction. The lower beam 62 may be spaced apart from the upper beam 61 in the up-down direction.

The front boss 63 may have a substantially cylindrical shape and protrude outward from the side wall 12 in the right-left direction. A rear end portion of the front boss 63 may be contiguous to a front end of the upper beam 61 and a front end of the lower beam 62.

The rear beam 64 may have a plate-like shape. The rear beam 64 may protrude outward from the side wall 12 in the right-left direction and extend in the up-down direction. An upper end of the rear beam 64 may be contiguous to a rear end of the upper beam 61, and a lower end of the rear beam 64 may be contiguous to a rear end of the lower beam 62. The rear beam 64 may be disposed such that the rear beam 64 and a support portion 71 of a bearing member 7 may be located on opposite sides of an engagement portion 73 of the bearing member 7 in the front-rear direction and the rear beam 64 may be located adjacent to a front portion of a coupling portion 72 of the bearing member 7 in a state where the bearing member 7 is attached to the side wall 12.

(4-1-4) Roller Accommodation Portion

As depicted in FIGS. 1, 3, and 5, the roller accommodation portion 68 may be disposed at a substantially middle portion of the lower wall 13 in the front-rear direction. The roller accommodation portion 68 may have a fourth opening 67 and comprise a pair of regulating plates 58.

The fourth opening 67 may have a substantially rectangular shape in plan view and be defined in the substantially middle portion in the lower wall 13. The fourth opening 67 may be defined at a position more forward than the position of the first opening 18 and more rearward than the position the third opening 51 in the front-rear direction. The fourth opening 67 may extend in the right-left direction in the lower wall 13 and pass through the side walls 12 in the right-left direction.

The regulating plate 58 may be disposed at each end portion of the fourth opening 67 in the right-left direction. Each regulating plate 58 may have a substantially U-shaped plate shape in side view and curved upward from the lower wall 13. The cartridge-side registration roller 8 may be capable of being accommodated in the roller accommodation portion 68 while being fitted in the curved portion of the regulating plate 58.

(4-2) Bearing Member

As depicted in FIGS. 8, 9A, and 9B, each bearing member 7 may comprise the support portion 71, the coupling portion 72, and the engagement portion 73. The bearing members 7 may have a symmetrical structure, and therefore, only one of the bearing members 7 is described in detail below.

The support portion 71 may have a substantially cylindrical shape extending in the right-left direction. An inner diameter of the support portion 71 may have substantially the same dimension as a diameter of a smaller-diameter portion 82 of the cartridge-side registration roller 8.

The coupling portion 72 may comprise a lateral beam 74 and a contact portion 75, and may extend in the front-rear direction.

The lateral beam 74 may extend forward from a front end of the support portion 71.

The contact portion 75 may protrude upward from a front end of the lateral beam 74. A front surface of the contact portion 75 may serve as a contact surface 75*a*.

The engagement portion 73 may be disposed at a position more inward than the coupling portion 72 in the right-left direction, and may be contiguous to the coupling portion 72. That is, the engagement portion 73 may be connected to the support portion 71 by the coupling portion 72. The engagement portion 73 may comprise a front protrusion 76 as an example of a second protrusion, a rear protrusion 77 as another example of the second protrusion, and a middle protrusion 78.

The front protrusion 76 may comprise a front-protrusion proximal end portion 76*d* and a front-protrusion distal end portion 76*a*.

The front-protrusion proximal end portion 76*d* may have a flat plate shape extending along the up-down direction, and may protrude inward from a forward portion of the coupling portion 72 in the right-left direction.

The front-protrusion distal end portion 76*a* may protrude inward from a distal end portion of the front-protrusion proximal end portion 76*d* in the right-left direction. The front-protrusion distal end portion 76*a* may have a hook-like shape and a dimension thereof in the up-down direction may be longer than a dimension of the front-protrusion proximal end portion 76*d* in the up-down direction. The front-protrusion distal end portion 76*a* may comprise a front barb surface 76*b* and a front inclined surface 76*c*. The front barb surface 76*b* may protrude forward from the distal end portion of the front-protrusion proximal end portion 76*d*. The front inclined surface 76*c* may be sloped rearward in an inward direction, relative to in the right-left direction, from a front end of the front barb surface 76*b*. The front-protrusion distal end portion 76*a* may have a substantially right triangular shape in plan view. More specifically, the front inclined surface 76*c* may be sloped forward to the left from a right end of the front-protrusion distal end portion 76*a*. In other words, the front inclined surface 76*c* may be inclined toward the third opening 51 of the drum frame 2 toward the right.

The front barb surface 76*b* may be inclined forward and toward the left from a left end of the front-protrusion distal end portion 76*a*. An inclined angle of the front barb surface 76*b* with respect to a protruding direction of the front-protrusion proximal end portion 76*d* may be greater than an inclined angle of the front inclined surface 76*c* with respect to the protruding direction of the front-protrusion proximal end portion 76*d*. The front end of the front barb surface 76*b* may be contiguous to the front end of the front inclined surface 76*c*. An inclined angle of the front barb surface 76*b* with respect to the protruding direction of the front-protrusion proximal end portion 76*d* may be greater than an inclined angle of the front projecting portion 54 with respect to the protruding direction of the front-protrusion proximal end portion 76*d*. The front barb surface 76*b* may be angled at an angle where the front barb surface 76*b* becomes more distant from the inclined surface of the front projecting portion 54 from the rear to the front.

The rear protrusion 77 may comprise a rear-protrusion proximal end portion 77*d* and a rear-protrusion distal end portion 77*a*.

The rear-protrusion proximal end portion 77*d* may comprise a flat plate shape extending along the up-down direction. The rear-protrusion proximal end portion 77*d* may protrude inward from a rearward portion of the coupling portion 72 in the right-left direction.

The rear-protrusion distal end portion 77*a* may protrude inward from a distal end portion of the rear-protrusion proximal end portion 77*d* in the right-left direction. The rear-protrusion distal end portion 77*a* may have a hook-like shape and a dimension thereof in the up-down direction may be longer than a dimension of the rear-protrusion proximal end portion 77*d* in the up-down direction. The rear-protrusion distal end portion 77*a* may comprise a rear barb surface 77*b* and a rear inclined surface 77*c*. The rear barb surface 77*b* may protrude rearward from the distal end portion of the rear-protrusion proximal end portion 77*d*. The rear inclined surface 77*c* may be inclined forward and inward in the right-left direction from a rear end of the rear barb surface 77*b*. The rear-protrusion distal end portion 77*a* may have a substantially right triangular shape in plan view. More specifically, the rear inclined surface 77*c* may be inclined rearward and to the left from a right end of the rear-protrusion distal end portion 77*a*. In other words, the rear inclined surface 77*c* may be inclined toward the third opening 51 of the drum frame 2 (e.g., toward the left).

The rear barb surface 77*b* may be inclined rearward and to the left from a left end of the rear-protrusion distal end portion 77*a*. An inclined angle of the rear barb surface 77*b* with respect to a protruding direction of the rear-protrusion proximal end portion 77*d* may be greater than an inclined angle of the rear inclined surface 77*c* with respect to the rear-protrusion proximal end portion 77*d*. The rear end of the rear barb surface 77*b* may be contiguous to the rear end of the rear inclined surface 77*c*. An inclined angle of the rear barb surface 77*b* with respect to the rear-protrusion proximal end portion 77*d* may be greater than an inclined angle of the rear projecting portion 55 with respect to the protruding direction of the rear-protrusion proximal end portion 77*d*. The rear barb surface 77*b* may be angled at an angle where the rear barb surface 77*b* becomes more distant from the inclined surface of the rear projecting portion 55 from the front to the rear.

The middle protrusion 78 may comprise a middle-protrusion proximal end portion 78*b* and a middle-protrusion distal end portion 78*a*.

The middle-protrusion proximal end portion 78*b* may have a flat plate shape extending along the up-down direction, and may protrude inward from a middle portion of the coupling portion 72 in the right-left direction.

The middle-protrusion distal end portion 78*a* may protrude inward from a distal end portion of the middle-protrusion proximal end portion 78*b* in the right-left direction. The middle-protrusion distal end portion 78*a* may have a flat plate shape and a dimension thereof in the up-down direction may be longer than a dimension of the middle-protrusion proximal end portion 78*b* in the up-down direction.

(4-3) Cartridge-Side Registration Roller

As depicted in FIGS. 5 and 8, the cartridge-side registration roller 8 may comprise a larger-diameter portion 81 and a pair of smaller-diameter portions 82.

The larger-diameter portion 81 may have a substantially cylindrical shape extending in the right-left direction. Both end portions of the larger-diameter portion 81 may extend to respective positions beyond positions at which the end portions may intersect the respective side walls 12 extending in the front-rear direction. The larger-diameter portion 81 may be configured to rotate and convey a sheet P in conjunction with the apparatus-side registration roller 40.

Each smaller-diameter portion 82 may have a substantially cylindrical shape extending in the right-left direction and have a diameter that may be smaller than a diameter of the larger-diameter portion 81.

The smaller-diameter portions 82 may be located at respective positions more outward than the larger-diameter portion 81 in the right-left direction and may be contiguous to respective ends of the larger-diameter portion 81. Entire portions of the smaller-diameter portions 82 may be located at respective position more outward than the respective side walls 12 in the right-left direction.

5. Assembling of Bearing Member to Cartridge-Side Registration Roller

As depicted in FIGS. 9A and 9B, in an assembling operation in which the bearing members 7 are assembled to the cartridge-side registration roller 8, first, an operator may place the cartridge-side registration roller 8 in the roller accommodation portion 68 of the lower wall 13. At that time, an entirety of the pair of smaller-diameter portions 82 may be located at the respective positions more outward than the respective side walls 12 in the right-left direction.

Next, the operator may position the bearing members 7 at respective positions more outward than the cartridge-side registration roller 8 in the right-left direction. At that time, the support portions 71 may be spaced apart from the respective smaller-diameter portions 82 in the right-left direction. For example, a second rotational axis L2 of the cartridge-side registration roller 8 and an axis of each support portion 71 may coincide with each other in the right-left direction (e.g., share the same axis).

Then, the operator may move the bearing members 7 inward in the right-left direction. Thus, as depicted in FIG. 8, the smaller-diameter portions 82 may be inserted into the respective support portions 71. Further, in each bearing member 7, the front protrusion 76, the rear protrusion 77, and the middle protrusion 78 may be inserted into the third opening 51.

Thus, as depicted in FIG. 8, the front protrusion 76 and the front projecting portion 54 may be engaged with each other while the front barb surface 76*b* and the inclined surface of the distal end portion of the front projecting portion 54 intimately contact each other. Further, the rear protrusion 77 and the rear projecting portion 55 may be engaged with each other while the rear barb surface 77*b* and the inclined surface of the distal end portion of the rear projecting portion 55 intimately contact each other. For example, a contact surface of the front protrusion 76 and the front projecting portion 54 and a contact surface of the rear protrusion 77 and the rear projecting portion 55 may be inclined relative to the right-left direction.

The contact portion 75 of the coupling portion 72, e.g., the contact surface 75*a*, may be located behind and adjacent to the rear beam 64 of the projecting portion 60. The contact surface 75*a* may be spaced apart from the rear beam 64 at a slight interval in the front-rear direction under a normal usage condition of the photosensitive body cartridge 1.

Therefore, the pair of bearing members 7 may be attached to the drum frame 2 while the cartridge-side registration roller 8 is rotatably supported by the support portions 71 of the pair of bearing members 7. At each end portion of the cartridge-side registration roller 8, the smaller-diameter portion 82 may be disposed at the position more outward than the engagement portion 73 of the bearing member 7 in the right-left direction, and the smaller-diameter portion 82 and the engagement portion 73 of the bearing member 7 may be disposed at opposite sides of the side wall 12.

Each bearing member 7 may be movable in the up-down direction in a state where the engagement portion 73 is in engagement with the frame protrusion 52. For example, each bearing member 7 may be movable in the up-down direction within a range between a state where upper ends of the front protrusion 76, the rear protrusion 77, and the middle protrusion 78 contact the upper projecting portion 53 of the frame protrusion 52 and a state where lower ends of the front protrusion 76, the rear protrusion 77, and the middle protrusion 78 contact the lower wall 13.

With this configuration, when the cartridge-side registration roller 8 rattles (e.g., move or vibrate) in the right-left direction, the front barb surface 76*b* and the rear barb surface 77*b* may engage with the inclined surface of the distal end portion of the front projecting portion 54 and the inclined surface of the distal end portion of the rear projecting portion 55, respectively, thereby reducing or preventing an occurrence of a disengagement of the bearing members 7 from the drum frame 2. In addition, when the cartridge-side registration roller 8 is located at a position higher than the lower edge of the third opening 51, the upper ends of the front-protrusion distal end portion 76*a*, the rear-protrusion distal end portion 77*a*, and the middle-protrusion distal end portion 78*a* may engage the upper projecting portion 53, thereby further reducing an occurrence of a disengagement of the bearing members 7 from the drum frame 2.

The pair of bearing members 7 may support the cartridge-side registration roller 8. Therefore, the pair of bearing members 7 and the cartridge-side registration roller 8 may move integrally in the up-down direction.

6. Attachment of Process Cartridge to Apparatus Body

Figure 10A:
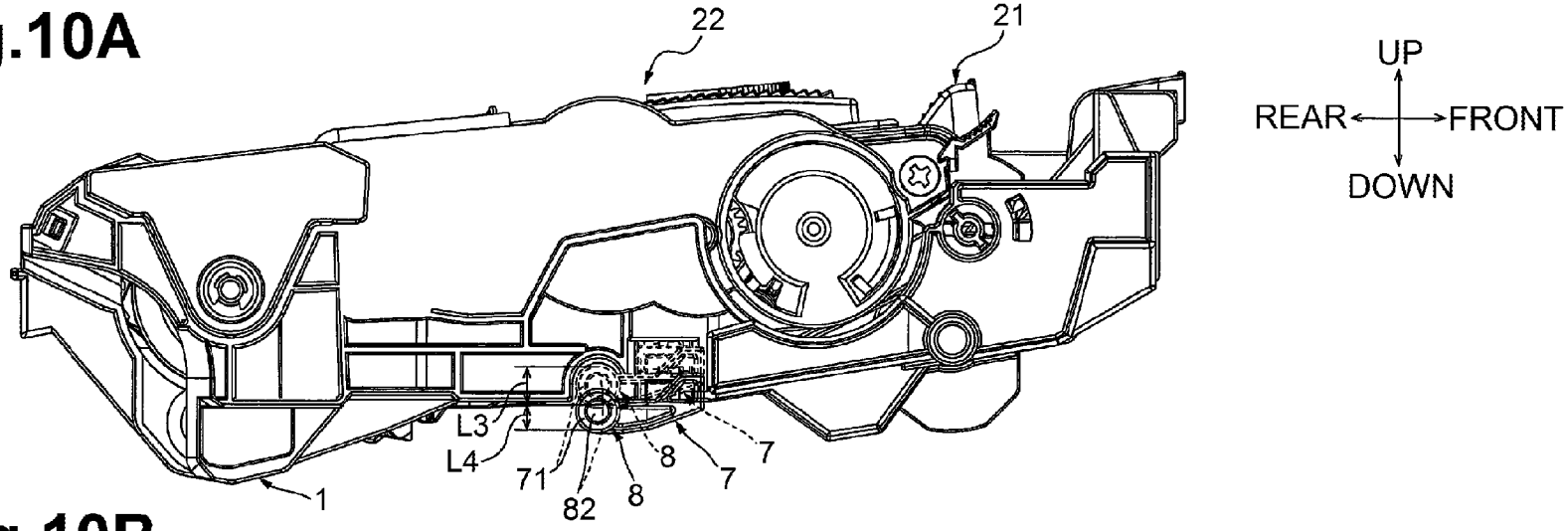
FIG. 10A is a left side view depicting the process cartridge in which the cartridge-side registration roller is located at a protruding position in the illustrative embodiment according to one or more aspects of the disclosure.

As depicted in FIG. 10A, before the process cartridge 22 is attached to the apparatus body 31, the bearing members 7 and the cartridge-side registration roller 8 may be located at a lower position due to their own weights while the engagement portions 73 are in engagement with the respective frame protrusions 52. In one example, each bearing member 7 may be moved downward to the lower position where the lower ends of the front protrusion 76, the rear protrusion 77, and the middle protrusion 78 may contact the lower wall 13, and the cartridge-side registration roller 8 may move downward in accordance with the downward movement. At that time, the cartridge-side registration roller 8 may be located at a protruding position where the cartridge-side registration roller 8 may slightly protrude downward while being spaced apart from the roller accommodation portion 68 of the drum frame 2 at a predetermined interval, as indicated by a solid line.

Thereafter, the operator may attach the process cartridge 22 to the apparatus body 31 while holding the handle 16. As depicted in FIG. 6, the operator may open the front cover 35 and attach the process cartridge 22 to the apparatus body 31 via the opening 34. Then, the cartridge-side registration roller 8 may be pressed upward by the apparatus-side registration roller 40 and thus may be guided to a retracted position where the cartridge-side registration roller 8 may be accommodated in the roller accommodation portion 68, as indicated by a dashed line in FIG. 10A.

A distance L4 between the retracted position and the protruding position of the cartridge-side registration roller 8 may be smaller than a diameter L3 of the larger-diameter portion 81 of the cartridge-side registration roller 8. For example, the cartridge-side registration roller 8 may be movable, by the distance L4, between the retracted position in which the cartridge-side registration roller 8 may be retracted toward the inward of the drum frame 2 along the up-down direction and the protruding position in which the cartridge-side registration roller 8 may be located at a lower position than the drum frame 2. The distance L4 may be smaller than the diameter L3 of the larger-diameter portion 81.

Figure 10B:
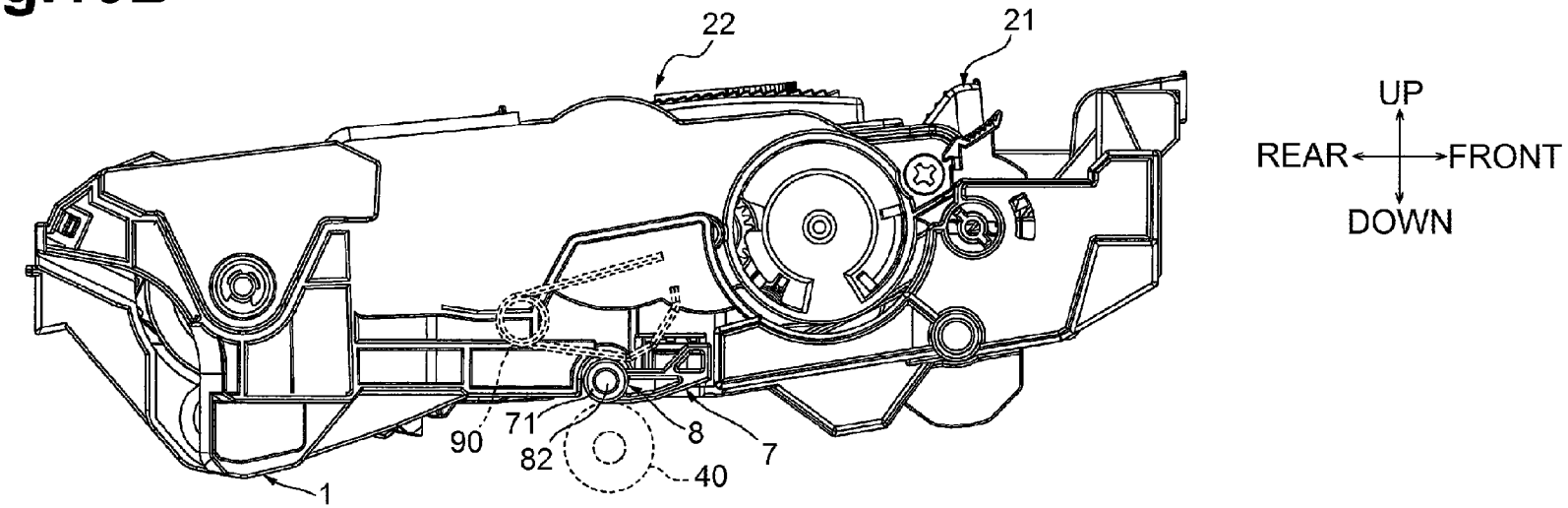
FIG. 10B is a left side view depicting the process cartridge in which the cartridge-side registration roller is located at a retracted position in the illustrative embodiment according to one or more aspects of the disclosure.

As depicted in FIGS. 6 and 10B, the upper end portions of the support portions 71 may contact springs, respectively, disposed in the apparatus body 31. With this configuration, the support portions 71 may be urged downward. Therefore, the lower end portion of the cartridge-side registration roller 8 supported by the support portions 71 and the upper end portion of the apparatus-side registration roller 40 may be in elastic contact with each other at all times. More specifically, the larger-diameter portion 81 of the cartridge-side registration roller 8 may be in contact with the upper end portion of the apparatus-side registration roller 40 at all times.

7. Effects (1) According to the above-described photosensitive body cartridge 1, as depicted in FIG. 8, an entirety of the smaller-diameter portions 82 may be located at the respective positions more outward than the respective engagement portions 73 in the right-left direction. Therefore, the larger-diameter portion 81 may extend to the positions where the larger-diameter portion 81 overlaps the engagement portions 73 in the right-left direction. Thus, in the cartridge-side registration roller 8, the larger-diameter portion 81 may be elongated, thereby increasing stiffness of the cartridge-side registration roller 8. Accordingly, this configuration may reduce the deformation of the cartridge-side registration roller 8 and increase a conveyance stability of a sheet P.

(2) According to the above-described photosensitive body cartridge 1, as depicted in FIG. 8, in the right-left direction, the smaller-diameter portions 82 may be located at the respective positions more outward than the respective side walls 12 and the larger-diameter portion 81 and the engagement portions 73 may be located at the respective positions more inward than the respective side walls 12. For example, the larger-diameter portion 81, rather than the smaller diameter portions 82, may be located at the positions more inward than the side walls 12. Therefore, in the cartridge-side registration roller 8, a portion that may come into contact with a sheet P during conveyance of the sheet P may include only the larger-diameter portion 81 having a higher rigidity. Consequently, this configuration may reduce deformation of the portion that may come into contact with the sheet P in the cartridge-side registration roller 8, and thus increase the conveyance stability of a sheet P.

(3) According to the above-described photosensitive body cartridge 1, as depicted in FIG. 9B, the front projecting portion 54 and the front protrusion 76 may be engaged with each other while extending in the right-left direction. Further, the rear projecting portion 55 and the rear protrusion 77 may be engaged with each other while extending in the right-left direction. Therefore, even when the cartridge-side registration roller 8 rattles in the front-rear direction, the front projecting portion 54, the rear projecting portion 55, the front protrusion 76, and the rear protrusion 77 may bend appropriately in the front-rear direction, thereby distributing the force exerted on the bearing members 7 from the cartridge-side registration roller 8. Consequently, this configuration may reduce the deformation of the cartridge-side registration roller 8.

(4) According to the above-described photosensitive body cartridge 1, as depicted in FIG. 8, the contact portion 75 of the coupling portion 72, e.g., the contact surface 75*a*, may be located adjacent to the rear beam 64 of the projecting portion 60 in the front-rear direction. Therefore, when the cartridge-side registration roller 8 rattles in the front-rear direction, the contact surface 75*a* may contact the rear beam 64 to restrict the forward movement of the coupling portion 72. Thus, this configuration may restrict the forward movement of the cartridge-side registration roller 8.

Further, when the cartridge-side registration roller 8 receives force in the right-left direction, the disengagement of the bearing members 7 from the respective side walls 12 may be restricted/prevented. For example, when the cartridge-side registration roller 8 receives force from the right to the left, the left bearing member 7 may rotate on the engagement portion 73 such that the support portion 71 may move apart from the side wall 12 by the engagement of the engagement portion 73 and the frame protrusion 52. For example, the bearing member 7 may attempt to rotate in a direction where the degree of contact of the front barb surface 76*b* and the front projecting portion 54 may become smaller in the front-rear direction. Accordingly, the contact of the contact surface 75*a* and the rear beam 64 may restrict such a movement of the bearing member 7. Therefore, the degree of contact of the front barb surface 76*b* and the front projecting portion 54 may be maintained at a sufficient level, thereby restricting and preventing the disengagement of the bearing members 7 from the respective side walls 12.

(5) According to the above-described photosensitive body cartridge 1, as depicted in FIG. 8, the lateral beam 74 of the coupling portion 72 may extend in the front-rear direction, thereby reducing a size of the photosensitive body cartridge 1 in the right-left direction.

(6) According to the above-described photosensitive body cartridge 1, as depicted in FIG. 8, the front protrusion 76 may engage the front projecting portion 54 like a hook. The rear protrusion 77 may also engage the rear projecting portion 55 like a hook. Therefore, the front protrusion 76 may be surely engaged with the front projecting portion 54. The rear protrusion 77 may also be surely engaged with the rear projecting portion 55.

The contact surface of the front projecting portion 54 and the front protrusion 76 and the contact surface of the rear projecting portion 55 and the rear protrusion 77 may be inclined relative to the right-left direction. Therefore, when the cartridge-side registration roller 8 rattles in the right-left direction, force exerted on the front projecting portion 54 from the front protrusion 76 and force exerted on the rear projecting portion 55 from the rear protrusion 77 may be distributed. For example, when the cartridge-side registration roller 8 rattles in the right-left direction, an application of load to the front projecting portion 54 and the rear projecting portion 55 may be reduced.

(7) According to the above-described photosensitive body cartridge 1, as depicted in FIG. 10A, the distance L4 in which the cartridge-side registration roller 8 may move between the retracted position and the protruding position may be shorter than the diameter L3 of the larger-diameter portion 81. Therefore, this configuration may restrict significant movement of the cartridge-side registration roller 8 in the up-down direction when the photosensitive body cartridge 1 is attached to the apparatus body 31. By restricting the movement of the cartridge-side registration roller 8 in such a manner, interference by the cartridge-side registration roller 8 with the attaching operation of the photosensitive body cartridge 1 to the apparatus body 31 may be prevented. Consequently, this configuration may achieve the smooth attachment of the photosensitive body cartridge 1 to the apparatus body 31.

8. Variations

In the above-described illustrative embodiment, in the process cartridge 22, the photosensitive body cartridge 1 and the developing cartridge 21 may have a detachable configuration. Nevertheless, in other embodiments, for example, the photosensitive body cartridge 1 and the developing cartridge 21 may have an integrated configuration.

In the above-described illustrative embodiment, the cartridge-side registration roller 8 may be made of metal. Nevertheless, in other embodiments, for example, the cartridge-side registration roller 8 may be made of resin.

What is claimed is:

1. A cartridge comprising:

a housing;

a sheet conveyor roller having a rotational axis, the sheet conveyor roller comprising:

a first portion configured to convey a sheet; and a second portion having a smaller diameter than the first portion, wherein the second portion extends from the first portion to an end of the sheet conveyor roller in a first direction in which the rotational axis of the sheet conveyor roller extends; and a bearing member configured to rotatably support the sheet conveyor roller, and comprising:

a support portion configured to rotatably support the second portion; and an engagement portion configured to engage with the housing, wherein, when the bearing member supports the sheet conveyor roller, an entirety of the second portion is located at a more outward position, relative to a midpoint of the sheet conveyor roller, than the engagement portion of the bearing member in the first direction in which the second portion extends from the first portion.

2. The cartridge according to claim 1, wherein the housing comprises a side wall extending in a direction perpendicular to the rotational axis of the sheet conveyor roller, and wherein the second portion and the engagement portion are disposed on opposite sides of the side wall.

3. The cartridge according to claim 2, wherein the side wall comprises a first opening that penetrates therethrough in the direction in which the rotational axis of the sheet conveyor roller extends, and a first protrusion protruding inwardly, relative to the housing from an edge of the first opening, in a second direction in which the rotational axis of the sheet conveyor roller extends, wherein the engagement portion comprises a second protrusion that extends in the second direction in which the rotational axis of the sheet conveyor roller extends and is configured to pass through the first opening, and wherein the second protrusion is configured to engage with the first protrusion.

4. The cartridge according to claim 3, wherein the side wall further comprises a second opening through which the sheet conveyor roller is configured to extend, and wherein the first opening and the second opening are physically distinct from one another.

5. The cartridge according to claim 2, wherein the side wall further comprises a projecting portion protruding outward relative to the housing in a second direction in which the rotational axis of the sheet conveyor roller extends, wherein the projecting portion and the support portion are disposed on opposite sides of the engagement portion in a direction substantially perpendicular to the rotational axis of the sheet conveyor roller, wherein the bearing member and the projecting portion are adjacent to each other in the direction substantially perpendicular to the rotational axis of the sheet conveyor roller.

6. The cartridge according to claim 1, wherein the bearing member further comprises a coupling portion that extends in a direction substantially perpendicular to the rotational axis, wherein the coupling portion is configured to couple the support portion with the engagement portion.

7. The cartridge according to claim 3, wherein the first protrusion comprises a distal end portion having a shape that is sloped in an inward direction relative to the opening toward a distal end of the first protrusion, and wherein the second protrusion comprises a distal end portion protruding inward relative to the housing and having a shape configured to contact the distal end portion of the first protrusion.

8. The cartridge according to claim 1, wherein the sheet conveyor roller is configured to be movable along a direction perpendicular to the rotational axis of the sheet conveyor roller between a retracted position where the sheet conveyor roller is located inside of the housing and a protruding position where the sheet conveyor roller is located outside of the housing and spaced apart from the retracted position at a predetermined distance, and wherein the predetermined distance between the retracted position and the protruding position is smaller than a diameter of the first portion.

9. The cartridge according to claim 1, wherein an entire sheet contacting surface of the sheet conveyor roller is made of metal.

10. The cartridge according to claim 1, further comprising a photosensitive body, wherein the housing is configured to rotatably support the photosensitive body.

11. The cartridge according to claim 1, wherein the support portion is cylindrical, and a maximum diameter of the support portion is equal to a diameter of the first portion.

12. The cartridge according to claim 1, wherein the sheet conveyor roller further comprises:

a third portion having a smaller diameter than the first portion, wherein the third portion extends from the first portion to another end of the sheet conveyor roller in a second direction in which the rotational axis of the sheet conveyor roller extends; and wherein the cartridge comprises another bearing member configured to rotatably support the sheet conveyor roller, and comprising:

a support portion configured to rotatably support the third portion; and an engagement portion configured to engage with the housing, wherein an entirety of the third portion is located at a more outward position, relative to the midpoint of the sheet conveyor roller, than the engagement portion of the other bearing member in the second direction in which the third portion extends from the first portion to the other end of the sheet conveyor roller.

13. The cartridge according to claim 12, wherein the housing comprises a side wall extending in a direction perpendicular to the rotational axis of the sheet conveyor roller, and wherein the third portion and the engagement portion of the other bearing member are disposed on opposite sides of the side wall.

14. The cartridge according to claim 13, wherein the side wall comprises a first opening that penetrates therethrough in the first direction in which the rotational axis of the sheet conveyor roller extends, and a first protrusion protruding inward relative to the housing from an edge of the first opening in a second direction in which the rotational axis of the sheet conveyor roller extends, wherein the engagement portion of the other bearing member comprises a second protrusion that extends in the second direction in which the rotational axis of the sheet conveyor roller extends and is configured to pass through the first opening, and wherein the second protrusion is configured to engage with the first protrusion.

15. A cartridge comprising:

a housing;

a metal roller longitudinally extending along a rotational axis, and comprising:

a sheet conveying portion; and a protruding portion having a smaller diameter than the sheet conveying portion, the protruding portion extending from a longitudinal end of the sheet conveying portion; and a bearing member configured to rotatably support the metal roller, and comprising:

a support portion configured to rotatably support the protruding portion of the roller; and an engagement portion configured to engage with the housing, wherein, when the bearing member supports the metal roller, an entirety of the protruding portion of the metal roller is located at a more outward position, relative to a longitudinal midpoint of the metal roller, than the engagement portion of the bearing member in a first direction in which the rotational axis extends.

16. The cartridge according to claim 15, wherein the housing comprises a side wall extending in a direction perpendicular to the rotational axis of the metal roller, and wherein the protruding portion and the engagement portion are disposed on opposite sides of the side wall.

17. The cartridge according to claim 16, wherein the side wall comprises a first opening that penetrates therethrough in the first direction in which the rotational axis of the metal roller extends, and a first protrusion protruding inwardly, relative to the housing from an edge of the first opening, in a second direction in which the rotational axis of the metal roller extends, wherein the engagement portion comprises a second protrusion that extends in the second direction in which the rotational axis of the metal roller extends and is configured to pass through the first opening, and wherein the second protrusion is configured to engage with the first protrusion.

18. The cartridge according to claim 17, wherein the side wall further comprises a second opening through which the metal roller is configured to extend, and wherein the first opening and the second opening are physically distinct from one another.

19. The cartridge according to claim 16, wherein the side wall further comprises a projecting portion protruding outward relative to the housing in a second direction in which the rotational axis of the metal roller extends, wherein the projecting portion and the support portion are disposed on opposite sides of the engagement portion in a direction substantially perpendicular to the rotational axis of the metal roller, and wherein the bearing member and the projecting portion are adjacent to each other in the direction substantially perpendicular to the rotational axis of the metal roller.

20. The cartridge according to claim 15, wherein the bearing member further comprises a coupling portion that extends in a direction substantially perpendicular to the rotational axis of the metal roller, wherein the coupling portion is configured to couple the support portion with the engagement portion.

* * * * *